United States Patent [19]

Galer et al.

[11] 4,126,259

[45] Nov. 21, 1978

[54] FRAME PINNING DEVICE

[75] Inventors: Edgar Galer, Birmingham; Paul S. Holt, Bilston, both of England.

[73] Assignee: E. H. Galer and Co. Limited, Birmingham, England

[21] Appl. No.: 811,268

[22] Filed: Jun. 29, 1977

[51] Int. Cl.[2] ..... B25C 1/02

[52] U.S. Cl. ..... 227/30; 227/148; 227/152

[58] Field of Search ..... 227/30, 129, 140, 148, 227/149, 151, 152

[56] References Cited

U.S. PATENT DOCUMENTS

| | | | |
|---|---|---|---|
| 199,579 | 1/1878 | Rose | 227/140 |
| 978,187 | 12/1910 | Miller | 227/149 |
| 1,094,079 | 4/1914 | Luppert | 227/129 |
| 1,998,328 | 4/1935 | McKinnie | 227/129 |

*Primary Examiner*—Granville Y. Custer, Jr.

*Attorney, Agent, or Firm*—Scrivener, Parker, Scrivener & Clarke

[57] ABSTRACT

A device for use without an external power source and comprising two hand-operated pinning assemblies arranged at 90° to each other with a foot operable jaw assembly for holding mitred picture frame moulding against the pinning assemblies during pinning, each pinning assembly incorporating a magazine for pins, and visible adjustable stops being provided to control the insertion depth of the pins.

8 Claims, 7 Drawing Figures

FRAME PINNING DEVICE

This invention relates to a device for pinning the mitred joints of picture frames.

It is known to clamp in abutment the mitred ends of two lengths of wooden picture frame moulding and to pin them together by the use of two compressed air guns which are arranged to drive two pins into the joint transversely to each other.

One problem with the known devices is that the guns are arranged to apply the pins with a predetermined force, and if a pin encounters abnormal resistance to its entry into the wood it frequently is not fully driven into place and may protrude from the surface of the moulding.

Another problem with such devices is that when a region of harder material is encountered by a pin it may under impact be diverted through the side of the moulding to project therefrom.

A furhter problem with such devices is that expensive compressed air facilities may not be available to the picture frame maker.

The object of the present inventin is to provide a simple manually driven device for pinning a mitred joint between the ends of two lengths of picture frame moulding.

According to our invention a device for pinning a mitred joint between the ends of two lengths of picture frame moulding comprises a support, releasable clamp means mounted on the support and adapted to clamp the lengths in assembled relationship to each other, and at least one pinning asembly mounted on the support and comprising a magazine for pins, a chamber adapted to receive the pins singly in succession from the magazine, a reciprocable pin drawer slidable in the chamber, and a hand-operable lever connected by a mechanical linkage to the pin drawer and arranged to advance the pin drawer through the chamber to drive a pin contained therein into the mitred joint upon application of a force to the lever by the operator. With such a device the operator is able to apply the minimum force to the pins required to force them in. Thus the pins are driven in relatively slowly rather than being shot in so that less damage is caused to the mitred joint. If a pin encounters abnormal resistance to its entry into the joint the operator can apply additional force to the linkage as required. A region of harder material does not tend to deflect the pins by the same amount as when the pins are shot in.

The avoidance of the use of compressed air also ensures that damage and possible accidents caused by accidental firing of the pins is obviated.

Stop means, which may be adjustable, are preferably provided to control the fully advanced position of the pin driver.

The stop means conveniently comprises a stop provided on the lever or the mechanical linkage and adapted to engage with an abutment fixed in use relative to the support, the stop and the abutment being visible to the operator to enable the operator to determine by inspection of the position of the stop relative to the abutment whether or not the pin driver is in the fully advanced position.

Preferably the pinning assembly comprises a housing of substantialy L-shape, a first limb of the housing being provided with a longitudinal bore of oblong rectangular cross-section constituting said magazine and terminating in said chamber which is defined within the housing adjacent to the angle of the L, and the second limb of the housing being provided with a bore extending longitudinally of that limb and in which is slidably guided a block secured to the pin driver.

Usually there will be two pinning assemblies mounted on the support and aranged to drive pins into the mitred joint at substantially 90° to each other.

Preferably the releasable clamp means comprises a pair of abutment faces extending at 90° to one another and fixed in use relative to the support, and a releasable jaw assembly comprising two jaw members which are slidable on the support in a direction substantially bisecting the angle between the abutment faces and which are slidable relative to each other in that direction, each jaw member having a clamping face extending parallel to the corresponding abutment face.

The jaw assembly is preferably spring-biassed towards the abutment faces, a lever being connected to the jaw assembly to enable an operator to retract the jaw assembly against the spring-biassing.

When the housings of the two assemblies are of L-shape they are preferably secured to the support with said first limbs of said housings extending at 90° to each other, said abutment faces comprising respective faces of said first limbs.

In order to enable the position at which a pin is inserted into the joint to be varied in the direction transverse to the plane in which lie in use the clamped lengths of moulding, at least one of the pinning assemblies is preferably adjustable in position relative to the support.

The two pinning assemblies are preferably operated by separate levers which may be moved simultaneously by the operator, but if desired they may be adapted to be operated simultaneously by one hand.

A device in accordance with the invention will now be described, by way of example only, with reference to the accompanying drawings in which.

Figure 1:
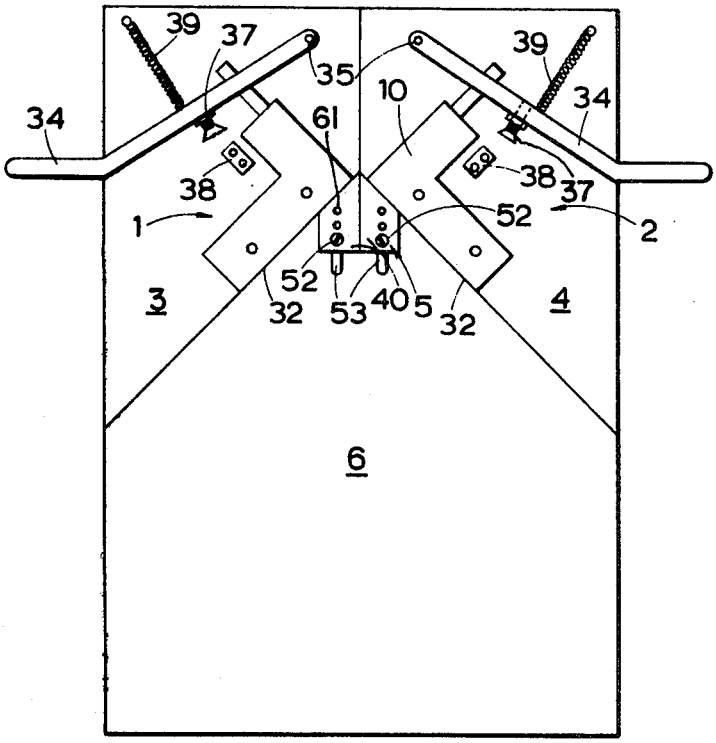
FIG. 1 is a view normal to the support plates showing the two pinning assemblies secured thereto, and the jaw assembly, the handles of the pinning assemblies being shown in their retracted positions.
Figure 2:
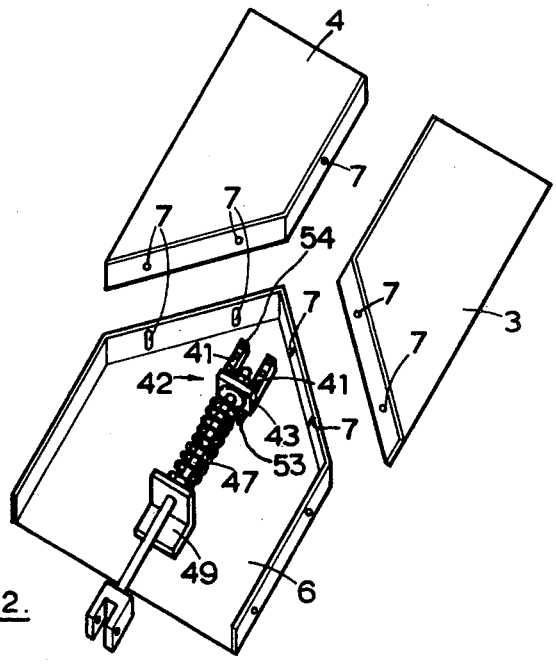
FIG. 2 is an exploded view from below of the three support plates showing the slotted holes which enable their relative movement, and the spring-biassing mechanism for the jaw assembly, shown in more detail in FIG. 5.

Referring to FIGS. 1 and 2 two pinning assemblies 1 and 2 are respectively mounted on first and second support plates, 3 and 4 respectively, and a releasable jaw assembly 5 is slidable on a third plate 6 the apex of which is right-angled. The plates 3 and 4 are of complementary shape to each other and to that of plate 6, and are secured together in use by bolts, not shown, passing through holes 7 in abutting flanges extending along the mating edges of the plates. The holes 7 in one flange of each pair of abutting flanges are slotted transversely of the flange to enable the plates 3 and 4 to be adjusted in position normally of the plate 6, whilst retaining parallelism of the plates. This enables adjustment of the pinning assemblies normal to the plate 6 and hence adjustment of the pin positions to accommodate mouldings of different dimensions.

Figure 3:
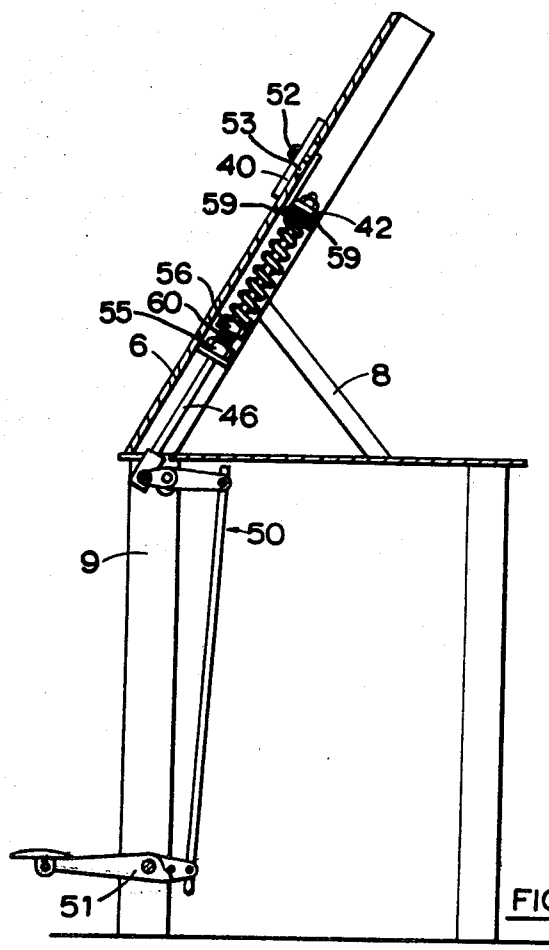
FIG. 3 is a side elevation of the support plates mounted on a stand and showing the foot-operable linkage to the releasable jaws, the pinning assemblies having been removed.

As shown in FIG. 3 the plate 6 is rigidly secured by its lower end and by an inclined strut 8 to a table 9 so that when the table is standing on a horizontal surface the plate 6 is inclined at an angle of 30° to the vertical which is convenient for the operator.

Figure 4:
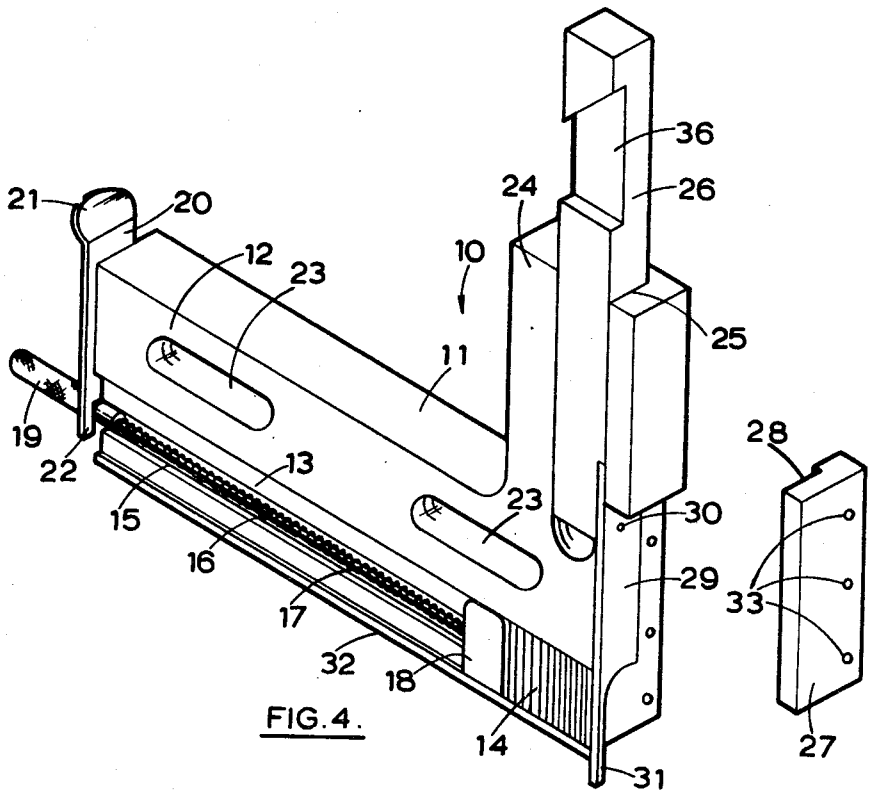
FIG. 4 is a perspective view of ne of the pinning assemblies, with the lever and a cover plate of the housing being removed, a nose plate being shown in a removed position.

Each of the pinning assemblies 1 and 2 comprises an L-shaped housing 10 of which the left hand one is shown in FIG. 4. Each housing 10 comprises an L-shaped body 11 of which the first limb 12 is formed adjacent to its outer edge with a longitudinal shallow recess 13 which defines with a cover plate, not shown, a bore of oblong-rectangular cross-section in which is received, as shown in FIG. 4, a file of loosely interconnected pins 14. A further recess 15 of semi-circular cross-section extends centrally of the recess 13 and accomodates a rod 16 on which is located a coil spring 17 which bears against an abutment, not shown, on a rectangular follower 18 bearing against the file of pins. The rear end of the spring 17 bears against a handle 19 on the rod 16, and the handle is held against outward movement by the engagement with a sheet metal clip 20 slidably secured to the free end of the first limb 12 of the body 11. Clip 20 is formed at one end with an angled tab 21 to enable it to be gripped and at its other end with a pair of prongs 22 which engage with an annular recess in the head 19. The body 11 and the cover plate are formed with slotted holes 23 to enable the housing 10 to be mounted adjustably on the corresponding support plate by screws.

The second limb 24 of the body 11 is formed with a blind longitudinal slot 25 of oblong-rectangular shape in cross-section in which is slidable an elongate block 26 which protrudes from the housing, and the second limb is cut away adjacent to the angle of the L-shape to receive a removable nose-piece 27. The nose-piece 27 is formed with a longitudinal recess 28 adjacent to one edge and co-operates with the body 11 and with the cover plate to define a bore of oblong-rectangular outline in cross-section in which is slidable a blade 29 secured by rivets 30 to the inner end of the block 26. The lower end of that bore defines a chamber in which is reciprocable a pin driver 31 formed on the free end of blade 29, the chamber communicating with the bore in which lies the file of needles 14. On downward movement in FIG. 4 of the pin driver 31 a pin held in said chamber and against nose-piece 27 by spring 17 is cut from the file by the pin driver 31 and is pushed into moulding held against the face 32 of the housing. Nose-piece 27 is normally held in place by screws passing through holes 33 and secured in the body 11.

Each pinning assembly further comprises a respective angled handle 34 pivoted at one end on the respective plate 3, 4 by a pivoted pin 35. The handle rides in a shaped cut-out 36 in the protruding portion of the respective block 26, the shaping of the cut-out 36 permitting linear movement of the block 26 with pivotal movement of the handle 34.

Each handle 34 is provided with an adjustable stop screw 37 for engagement with a respective abutment block 38 secured to the respective plate 3, 4 to control the travel of the respective pin driver 31 and hence the depths of insertion of the pins into the moulding. The handles 34 are each provided with a return spring 39 for retracting the blocks 26 and pin driver 31 after insertion of the pins into the joint.

As shown in FIG. 1, the two housings are mounted on the plates 3 and 4 with the face 32 of the first limb 12 of each housing extending along the edge of the plate 3, 4 adjacent to plate 6 to define two abutment faces at 90° to each other against which two mitred lengths of moulding may be clamped in assembled relationship by jaw assembly 5. The angled free ends of the handles 34 extend outwardly in opposite directions so that they may be comfortably gripped by the two hands of the operator and drawn downwards together towards the operator's waist to insert two pins into a joint transversely to each other when the moulding is held against the surfaces 32 by the jaw assembly 5. The relative transverse positions of the pins is altered by adjusting the positions of the plates 3 and 4 as previously explained.

Since the adjusting screws 37 and abutments 38 are clearly visible the operator is able to detect whether or not he or she has exerted sufficient pressure on each handle to drive the pins fully into the moulding.

Jaw assembly 5 comprises a pair of jaws 40 each of which is secured by a respective screw 52 passing through a respective guide slot 53 in plate 6 to a respective arm 41 of a compensating assembly 42 located on the rear side of plate 6.

Figure 7:
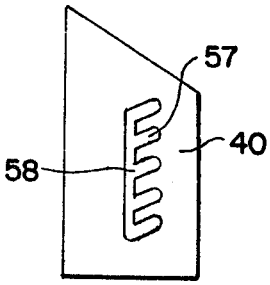
FIG. 7 shows a modified jaw.

The jaws 40 are each provided with three holes 61 and the arms 41 each with three holes to enable adjustment of the jaws 40 relative to the arms 41 to accommodate mouldings of different widths. In a modification, shown in FIG. 7, the three holes 61 in the jaws are replaced by five short spaced-part slots 57 which branch from a main slot 58 to enable adjustment of the jaw positions by slackening of the screws 52 but without their removal.

Figure 5:
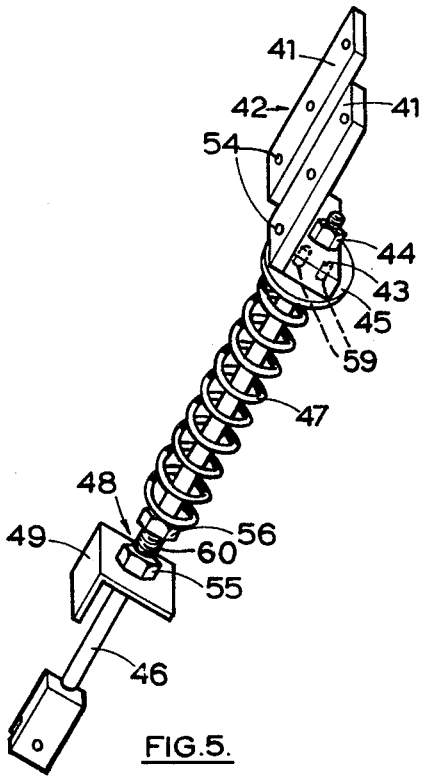
FIG. 5 shows the spring-biassing mechanism for the jaw assembly.

The compensating assembly 42 further comprises a bar 43 pivotally connected at its opposite ends by pivot pins 54 to the arms 41. The side of the bar 43 adjacent to the washer 45 is provided with a pair of hardened projecting studs 59, shown in FIGS. 3 and 5 43 to rock about its central transverse axis and permit a degree of relative sliding movement of the jaws 40 to accommodate the joining of two pieces of moulding of slightly different widths.

A strong compression spring 47 is mounted on rod 46 and acts between an adjustment assembly 48 through which the rod is slidable and washer 45 to bias the jaws 40 upwardly in FIG. 1. The assembly 48 comprises two nuts 55 and 56, the nut 56 being threaded on an externally threaded tubular boss 60 integral at one end with the nut 55 which abuts against a bracket 49 secured to the plate 6. Rod 46 has its free end 46 connected by a linkage 50 to a foldable foot pedal assembly 51 mounted at floor level. The spring 47 normally urges the jaws 40 towards the abutment surfaces 32 but on depression of the foot pedal the pre-loading of spring 47 is overcome to retract the jaws 40 and allow insertion or removal of moulding.

Figure 6:
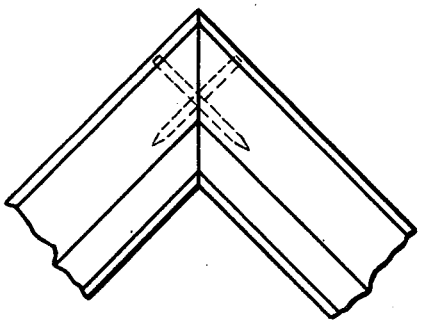
FIG. 6 is a view of a mitred joint between the ends of two lengths of picture frame moulding that has been pinned by the device shown in FIGS. 1 to 5.

The operation of the device will now be described. Screws 37 are first adjusted to determine the range of movement of the pin drivers 31 and thus the depth of penetration of the pins into the picture frame moulding. The transverse position of plates 3 and 4 relative to plate 6 are adjusted by means of the bolts passing through holes 7 to determine the transverse spacing between the pins inserted into a mitred joint by the two pinning assemblies 1 and 2. The screws 52 are inserted into suitable pairs of holes 61 such that on depression of foot pedal assembly 51 the jaws 40 are retracted sufficiently to enable two pieces of moulding with mitred ends to be located in position on plate 6 with their mitred ends in abutment and in engagement with respective faces 32. The pedal assembly 51 is then released, and spring 47 forces jaws 40 into engagement with the pieces of moulding to clamp them against faces 32 with their mitred ends in face contact with each other. The operator then draws the levers 34 towards him as far as they will go, as determined by engagement of screws 37 with abutments 38, so that a pin 41 is driven by the pin driver 31 of each assembly, 1,2 into the mitred joint, to produce the pinned joint shown in FIG. 6. Pedal assembly 51 is then depressed to release jaws 40 to enable the pinned lengths of moulding to be removed from the device.

It will be appreciated that on relase of arms 34 the arms are retracted upwardly in FIG. 1 by springs 39 to draw back the needle drivers 31 and allow the pins 14 to be advanced by follower 18 under the force of spring 17 to bring a fresh pin into the path of each pin driver 31 for pinning a further joint.

We claim:

1. A device for pinning a mitred joint between the ends of two lengths of picture frame moulding comprising a support, releasable clamp means mounted on said support for clamping the length in assembled relationship to each other, and two pinning assemblies mounted on said support and arranged to drive pins into the mitred joint at substantially 90° to each other, each pinning assembly comprising a housing provided with a magazine for pins and with a chamber for receiving the pins singly in succession frm said magazine, a reciprocable pin driver slidable in said chamber of said housing, and a hand-operable lever conncted by a mechanical linkage to said pin driver for advancing said pin driver through said chamber, said releasable clamp means comprising a pair of abutment faces extending at 90° to each other and fixed relative to said support, a releasable jaw assembly comprising two jaw members which are slidable on said support in a direction substantially bisecting the angle between said abutment faces and which are slidable relative to each other in that direction, each of said jaw members having a clamping face extending parallel to the corresponding one of said abutment faces, resilient means biasing said jaw members towards said abutment faces, and a further lever connected to said jaw member for retracting said jaw members against said resilient means.

2. A device as in claim 1 wherein said housing of said pinning assembly is of substantially L-shape, a first limb of said housing being provided with a longitudinal bore of oblong rectangular cross-section constituting said magazine and terminating in said chamber which is defined within the housing adjacent to the angle of the L, and a second limb of said housing being provided with a second bore extending longitudinally of said second limb, a block secured to said pin driver being slidably guided in said second bore.

3. A device as in claim 2 wherein said block protrudes from said housing and is engaged by said lever, said lever being pivoted on said support.

4. A device as in claim 1 in which said hand-operable levers are each pivotable in a plane which is parallel to the plane in which the clamped lengths of moulding lie in use.

5. A device as in claim 4 wherein said support is adapted to stand on a horizontal surface and the arrangement is such that when the device is stood on a horizontal surface said two hand-operable levers are inclined downwardly from their respective pivots at substantially the same angle to the vertical, and outwardly with respect to each other.

6. A device as in claim 4 wherein the arrangement is such that in use the plane in which lies the clamped lengths of moulding is inclined at an acute angle to the vertical.

7. A device for pinning a mitred joint between the ends of two lengths of picture frame moulding comprising a support, releasable clamp means mounted on said support for clamping the lengths in assembled relationship to each other, and two pinning assemblies mounted on said support and arranged to drive pins into the mitred joint at substantially 90° to each other, each pinning assembly comprising a housing provided with a magazine for pins and with a chamber for receiving the pins singly in succession from said magazine, a reciprocable pin driver slidable in said chamber of said housing, and a hand-operable lever connected by a mechanical linkage to said pin driver for advancing said pin driver through said chamber, said support comprising a first plate and two further plates which areadjacent to and parallel to said first plate and are adjustable in position relative to said first plate in the direction normal to said first plate, said pinning assemblies being mounted respectively on said further plates.

8. A device as in claim 7 wherein each of said plates is formed with a flange along the edge that abuts an adjacent plate and the flanges of adjacent plates are secured together by bolts extending through slotted holes in said flanges.

* * * * *